United States Patent [19]

Walenta

[11] 4,179,608

[45] Dec. 18, 1979

[54] RIGHT/LEFT ASSIGNMENT IN DRIFT CHAMBERS AND PROPORTIONAL MULTIWIRE CHAMBERS (PWC'S) USING INDUCED SIGNALS

[75] Inventor: Albert H. Walenta, Upton, N.Y.

[73] Assignee: The United States of America as represented by the United States Department of Energy, Washington, D.C.

[21] Appl. No.: 904,678

[22] Filed: May 10, 1978

[51] Int. Cl.[2] ..... H01J 39/28

[52] U.S. Cl. ..... 250/385

[58] Field of Search ..... 250/385, 394, 374, 375, 250/382, 389

[56] References Cited

PUBLICATIONS

G. Charpak et al., "High-Accuracy, Two-Dimensional Readout in Multiwire Proportional Chambers", Nucl. Instru. and Meth., vol. 113, 1973, pp. 381-385.

P. Glassel et al., "A Position-Sensitive Multiwire Proportional Chamber for Fission Fragments with Large Solid Angle", Nucl. Instru. and Meth., vol. 141, 1977, pp. 111-114.

C. Sikkema, "A Multiwire Proportional Chamber as a Polarimeter for Fast Neutrons", Nucl. Instr. and Meth., vol. 122, 1974, pp. 415-431.

*Primary Examiner*—Alfred E. Smith
*Assistant Examiner*—Carolyn E. Fields
*Attorney, Agent, or Firm*—Dean E. Carlson; Leonard Belkin; Cornell D. Cornish

[57] ABSTRACT

Improved multiwire chamber having means for resolving the left/right ambiguity in the location of an ionizing event. The chamber includes a plurality of spaced parallel anode wires positioned between spaced planar cathodes. Associated with each of the anode wires are a pair of localizing wires, one positioned on either side of the anode wire. The localizing wires are connected to a differential amplifier whose output polarity is determined by whether the ionizing event occurs to the right or left of the anode wire.

6 Claims, 10 Drawing Figures

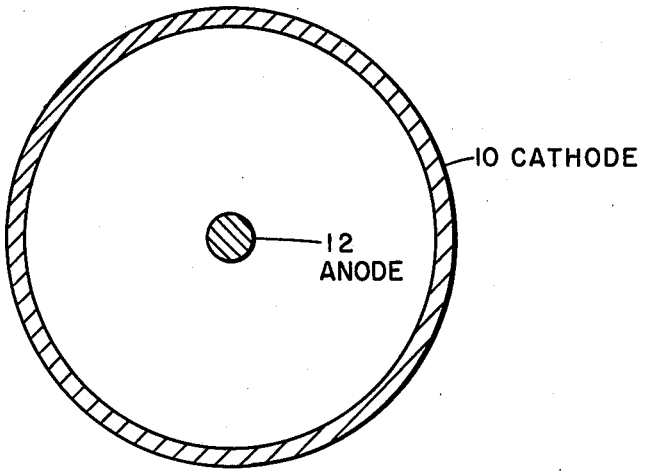
*Fig. 1* PRIOR ART DEVICE
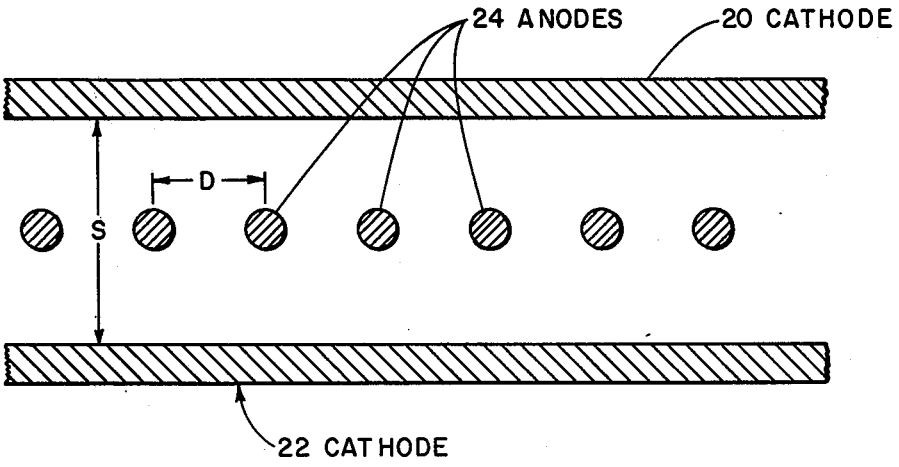
*Fig. 2* PRIOR ART DEVICE

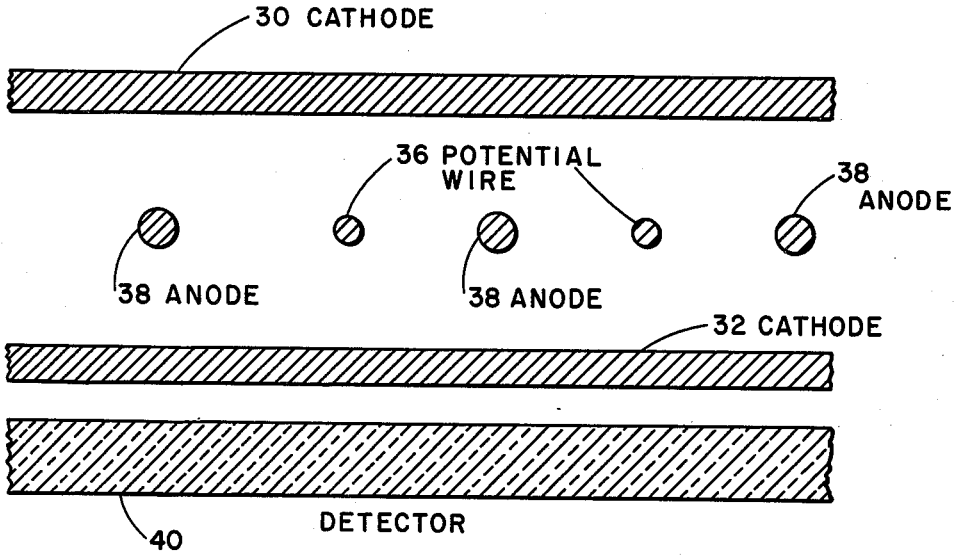
*Fig. 3* PRIOR ART DEVICE
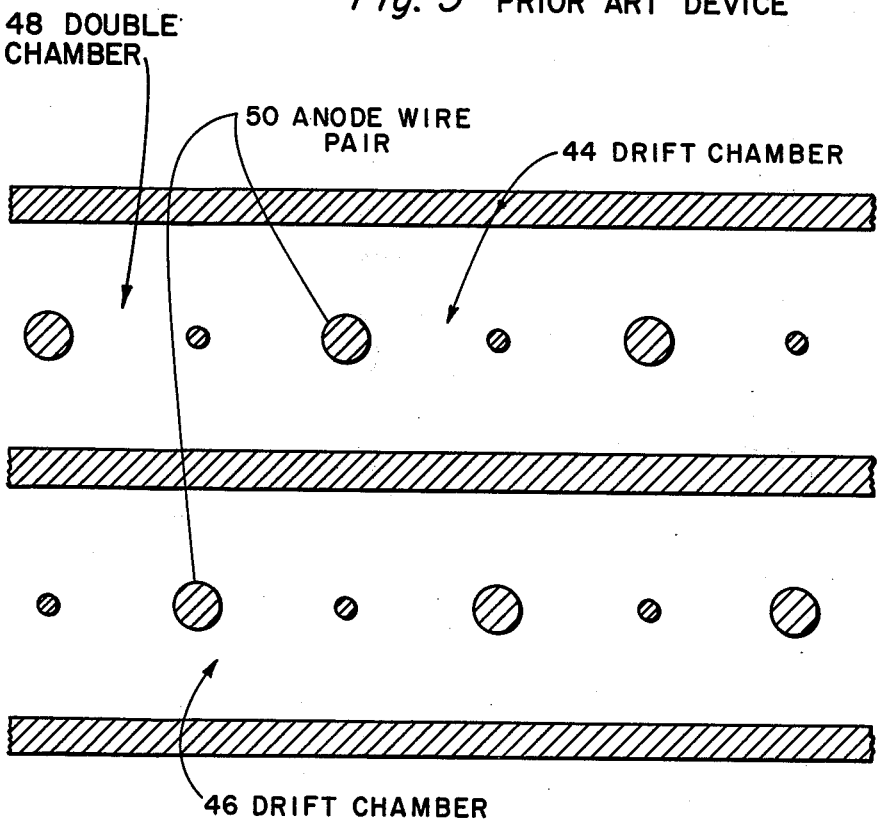
*Fig. 4* PRIOR ART DEVICE

RIGHT/LEFT ASSIGNMENT IN DRIFT CHAMBERS AND PROPORTIONAL MULTIWIRE CHAMBERS (PWC'S) USING INDUCED SIGNALS

BACKGROUND AND BRIEF SUMMARY OF THE INVENTION

FIG. 1 shows a cross sectional view of a basic proportional counter. Cathode 10, which is shown, for simplicity, as cylindrical, surrounds thin wire anode 12 and forms a chamber which contains a suitable gas. Cathode 10 is made thin enough or window means may be provided so that radiation of interest may enter the chamber. In the chamber the radiation will react with the gas to form ion pairs. Electrons released by this pair formation are accelerated towards the positively charged anode, while the positive ion formed is accelerated more slowly towards the cathode. As the electrons approach the anode, they acquire sufficient energy to form other ion pairs. The electrons released by the secondary pair formations in turn form still more pairs and so on. This phenomena is commonly referred to as "avalanche formation." When these avalanche electrons reach the anode, and as the positive ions formed move towards the cathode, they cause an electrical signal which may be detected by an electronic means, not shown. By a proper choice of the potential of the anode with respect to the cathode, the magnitude of the signal will be proportional to the energy of the incident radiation, hence the name "proportional counter."

When measurement of the energy of the incident radiation is not a factor such devices may be operated with a higher potential or a different gas so that the signal is not directly proportional to the energy. Such a mode of operation is known to those skilled in the art of nuclear instrumentation as operation in the limited proportional region. Hereinafter, it is to be understood that all devices and methods described may be operated in the "limited" as well as the directly proportional region.

The principle of the proportional counter may be used in a radiation detector designed to localize in space the occurrence of radiation. FIG. 2 shows a standard multiwire proportional chamber, one device which may be used for this purpose. The spaced parallel planar cathodes 20 and 22 now form the boundaries of the chamber. Avalanches caused by radiation incident upon the chamber will be detected by the closest of anodes 24. Thus, if the spacing between cathodes 20, 22 is S and the distance between anodes 24 is D, a signal occurring on a particular anode will serve to localize the occurrence or radiation approximately within a D by S rectangle centered on the particular anode. Means for localizing the event in the orthogonal direction are well known to those skilled in the art of nuclear instrumentation, and need not be further discussed here.

Since the spacing in a multiwire proportional chamber is typically on the order of two millimeters, leading to a large number of anode wires and a high cost for the associated electronics in a typical device, it is desirable to provide a means for localizing radiation events having a greater spacing between anode wires. FIG. 3 shows a typical drift chamber, one means having such an increased spacing. Spaced planar cathodes 30 and 32 serve to bound a gas-filled chamber containing anode wires 38. Radiation which forms ion pairs within the chamber continues on and is detected by detection means 40. Scintillation counters are a suitable detection means where the ionizing radiation consists of charged particles. Other detection means suitable for electromagnetic and neutral radiation are well known to those skilled in the art of nuclear instrumentation and need not be discussed further here. Since ionizing radiation travels at high speeds compared to the speeds at which electrons move to the anode, the output signal of the detection means 40 approximately establishes the time at which the ion pair was formed. Thus the difference between the times of the output signal of detecting means 40 and the detection of a signal on a particular anode wire 38 is a measure of the approximate distance between the point where an ion pair is formed and the anode wire. The accuracy of the drift chamber is improved by addition of potential wires 36 which serve to insure a more uniform field around anode wires 38.

Details of a design, construction and use of multiwire proportional chambers and of drift chambers are well known to those skilled in the art of nuclear instrumentation and do not require further discussion here. However, it may be seen by examining the symmetry of the structures shown in FIGS. 2 and 3 that there is an inherent ambiguity as to whether an ionizing event occurs to the left or to the right of a particular anode wire. One method for resolving this ambiguity, known as the "double wire" method, is to replace each of anode wires 38 with a closely spaced pair of wires, each having its own associated electronics. Another method for resolving this ambiguity, known as the "double chamber" method, is illustrated in FIG. 4. Double chamber 48 comprises adjacent drift chambers 44 and 46, so arranged that incident radiation causes ionization events in each of chambers 44 and 46. Because of the arrangement of chambers 44 and 46, these ionization events are detected by unique pairs of anode wires 50.

It will be obvious that each of these methods of resolving the left/right ambiguity involves an increased complexity of the chamber structures as well as requiring an increased amount of electronics. Further problems arise for "double chamber" type detectors for radiation tracks not normal to the chamber plane.

The subject invention substantially overcomes the above-described left/right ambiguity problem by means of an improved multiwire chamber wherein the improvement comprises; a pair of localizing wires coextensive with and spaced from each of the anode wires in said multiwire chamber, one of said localizing wires being located on either side of said anode wire; and, differential amplifier means for detecting the signal difference on each wire of said pair. (By multiwire chamber herein is meant a chamber as described hereinabove, having a plurality of anode wires, whether such a chamber be of the multiwire proportional chamber type or of the drift chamber type.) In the subject invention, the left/right information is obtained from the polarity of the difference signal produced by the differential amplifier. In practice, a short signal is desired in order to process high counting rates, while a signal as large as is practicable is desired to permit a clear left/right distinction. To balance these objects, a difference signal is differentiated with a time constant which is matched to the particular application. In general, the design of the differential amplifier and the associated electronics will be obvious for persons skilled in the art of nuclear instrumentation.

The above-described localizing wires may also serve other functions in the multiwire chamber. In one embodiment of the subject invention the multiwire chamber may be a drift chamber and the localizing wires may be potential wires.

In a second embodiment invention the multiwire chamber may be a multiwire proportional chamber, and the localizing wires for each anode wire may be the adjacent anode wires.

In another embodiment of the subject invention, the multiwire chamber may be a drift chamber, having a large spacing between anode wires. In such a drift chamber, field shaping electrodes are provided in close proximity to the cathodes. These field shaping electrodes may serve as localizing wires in this embodiment.

Therefore, it is an object of this invention to provide an improved multiwire chamber for the detection and localization of radiation, said chamber having means for resolving the left/right ambiguity, whereby the error in localization is reduced by a factor of 2.

It is another object of the subject invention to provide such an improved multiwire chamber which has a minimal increase in the complexity of the chamber structure and a minimal increase in the amount of required electronics.

It is another object of the subject invention to provide a multiwire chamber, having the capability to resolve the left right ambiguity and which has reduced sensitivity to the angle of incidence of the radiation being detected.

It is still another object of the subject invention to provide an improved multiwire chamber, having the capability to resolve the left/right ambiguity, which is low in cost. Other objects of the subject invention will become apparent in the discussion hereinafter.

BRIEF DESCRIPTION OF THE DRAWINGS

FIG. 1 is a cross-sectional view of a basic proportional counter.

FIG. 2 is a partial, simplified cross-sectional view of a standard multiwire proportional chamber showing the configuration of the electrodes.

FIG. 3 is a partial, simplified cross-sectional view of a standard drift chamber showing the configuration of the electrodes.

FIG. 4 is a partial, simplified cross-sectional view of a "double chamber" detector.

DETAILED DESCRIPTION OF THE INVENTION

Figure 5:
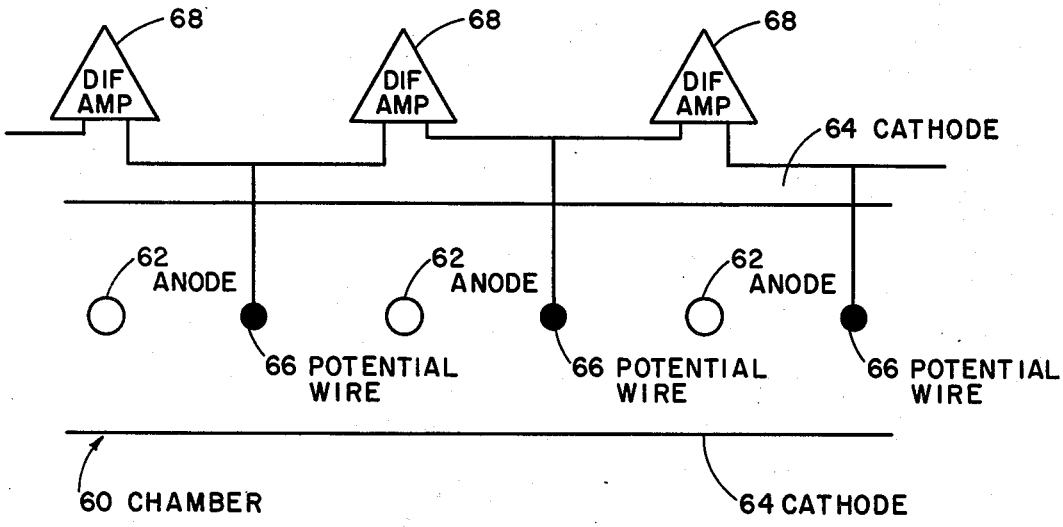
FIG. 5 is a schematic cross-section of a drift chamber embodiment of the subject invention.

Referring to FIG. 5, there is shown a schematic cross section of a portion of one embodiment of the subject invention wherein the multiwire chamber is a multiwire drift chamber 60. Spaced planar parallel cathodes 64 define a portion of the boundary of chamber 60. Other means, not shown, complete the enclosure of chamber 60. The chamber is filled with a suitable ionizable gas chosen to provide uniform drift conditions throughout the chamber and to produce a sufficient number of ion pairs for each ionizing event. Suitable gases are well known to those skilled in the art, and the choice need not be discussed further here. Anode wires 62 are maintained at a positive potential chosen so that a signal caused by incidence radiation will be easily detectable. Anode wires 62 extend across the chamber in the direction normal to the plane of FIG. 5 and are evenly spaced across the chamber in the orthogonal direction. Chamber 60 is divided into symmetrical cells by potential wires 66 which are maintained at a negative potential with respect to anode wires 62, and which serve to provide a more uniform field within the cells and define the regions associated with each of anode wires 62. Typically the spacing between anode wires 62 will be on the order of centimeters as is the spacing between potential wires 66.

In use detection of radiation particles and drift time information will be obtained by a means of detection, not shown, and electronics, also not shown, associated with each of anode wires 62. Details of the design, construction, and operation of these aspects of a multiwire drift chamber are well known to those skilled in the art and need not be discussed further here.

A differential amplifier 68 is associated with each of anode wires 62. The inputs of amplifiers 68 are each connected to one of the potential wires 66 adjacent to the associated anode wire 62. When an avalanche is caused at one of the anode wires 62 by incidence radiation occurring on one side of anode wire 62, a more positive signal will be induced on the closer of the adjacent potential wires 66. Thus radiation incident on one side of anode 62 will cause amplifier 68 to have an output opposite in polarity to that caused by radiation incident on the other side of anode 62. In order to achieve a proper balance between a short output signal from amplifiers 68, desirable to achieve high detection rates, and a large amplitude signal, desirable to achieve a clear resolution of the left/right ambiguity, signal processing electronics may be associated with each of amplifiers 68. While the optimum design of amplifiers 68 and associated electronics may vary, depending upon the application, an appropriate choice of design would be within the skill of a person skilled in the art of nuclear instrumentation.

Figure 6:
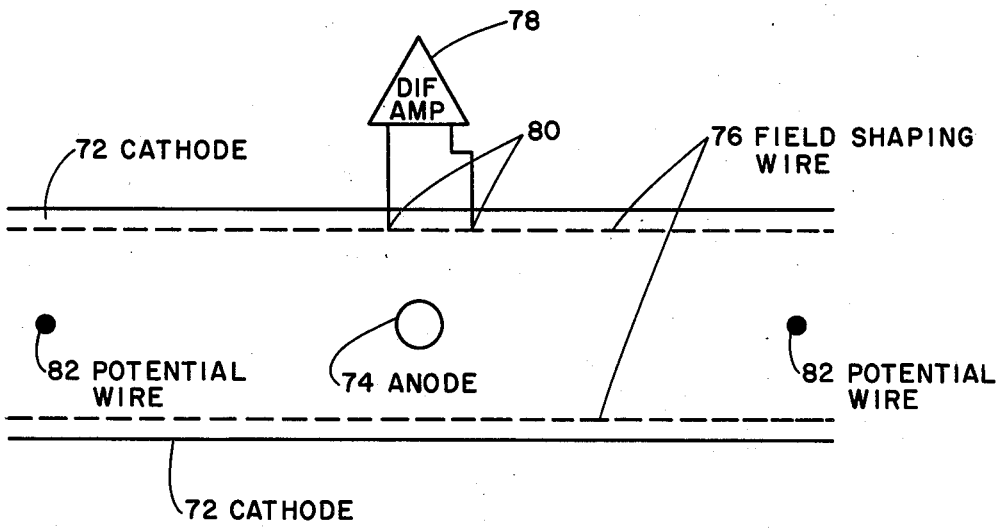
FIG. 6 is a schematic cross-section of a drift chamber embodiment of the subject invention having field shaping electrode.

Referring now to FIG. 6, there is shown in schematic a cross section of one cell of an embodiment of the subject invention wherein the multiwire chamber is a multiwire drift chamber, having a large spacing between anode wires. Typically, this spacing may be on the order of ten centimeters. In this embodiment of the subject invention, field shaping wires 76 are positioned adjacent to cathodes 72. Field shaping wires 76 are maintained at graduated potentials which serve to create a more uniform electrical field over the larger cell of the drift chamber of this embodiment of the subject invention. In this embodiment, a pair 80 of field shaping wires 76, which bracket anode wire 74, are connected to differential amplifier 78 and serve as the localizing wires. Other aspects of the operation and design of this embodiment of the subject invention are essentially similar to those of the embodiment depicted in FIG. 5 and described hereinabove and need not be discussed further here.

The subject invention may also be embodied in drift chambers having only anode wires. The functioning of the subject invention in such an embodiment with respect to resolution of the left/right ambiguity is essentially similar to the functioning of proportional multiwire chambers shown in FIG. 7 and discussed below.

Figure 7:
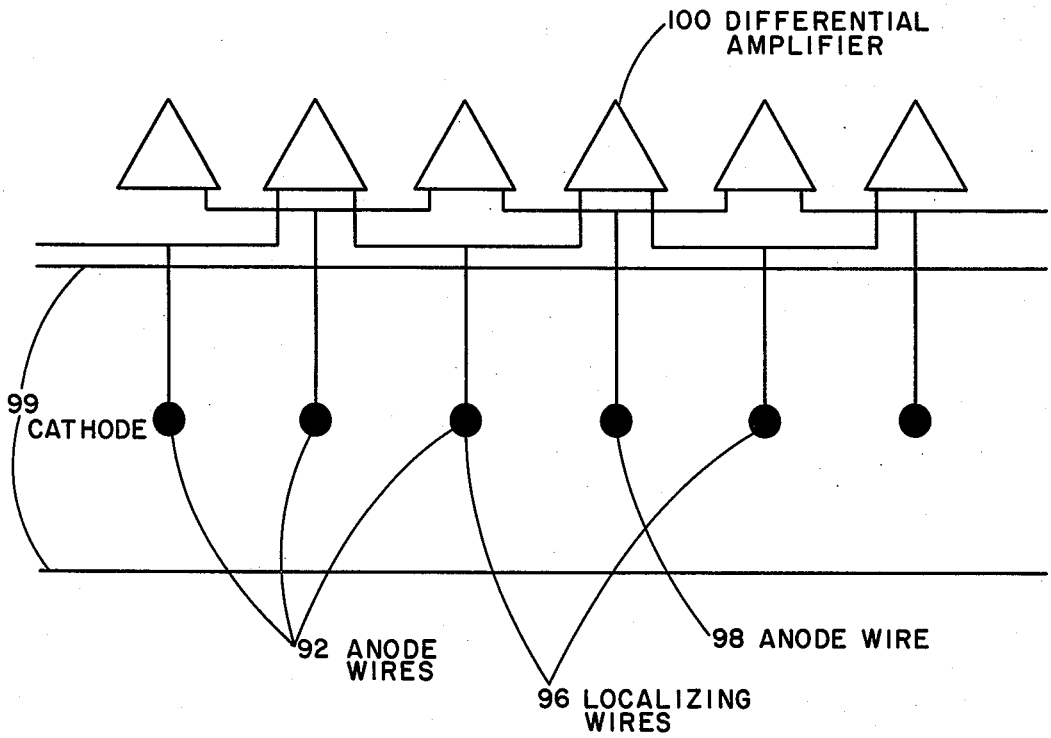
FIG. 7 is a schematic cross-section of a proportional multiwire chamber embodiment of the subject invention.

Referring now to FIG. 7, there is shown a schematic cross section of a portion of an embodiment of the subject invention wherein the multiwire chamber is a proportional multiwire chamber. In this embodiment, no drift time information is obtained, and the accuracy with which the location of the incident radiation is determined is dependent upon the spacing of the anode wires 92, which is typically on the order of 2 millimeters. A pair of anode wires 96 adjacent to a particular anode wire 98 is connected to the associated differential amplifier 100 and serve as the localizing wires in this embodiment. With the above-mentioned exception of the lack of means for determining drift times, other aspects of the operation of this embodiment of the subject invention are essentially similar to those of the embodiments depicted in FIGS. 5 and 6 and described hereinabove and need not be discussed further here.

EXPERIMENTAL EXAMPLE

Figure 8:
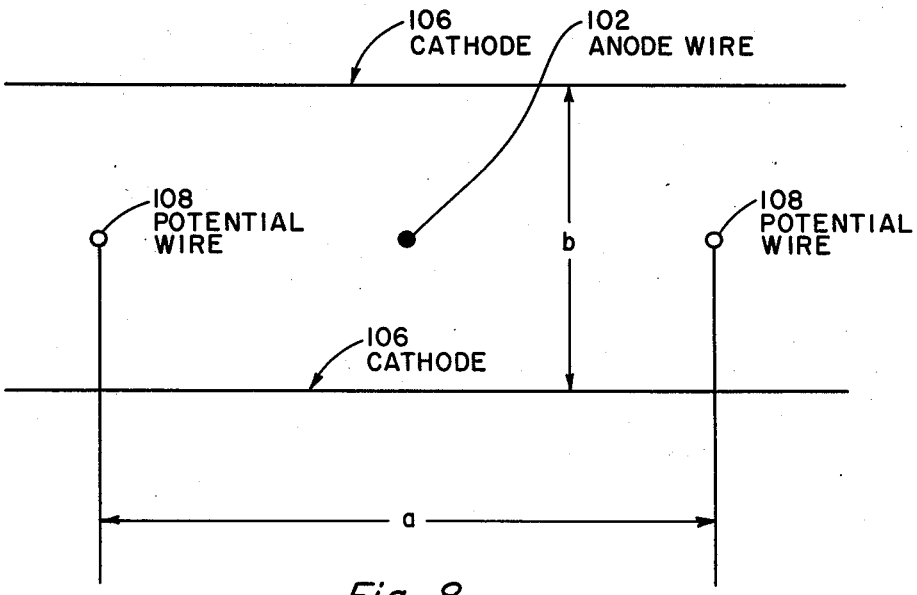
FIG. 8 is a schematic cross-section of an experimental version of the subject invention.
Figure 9:
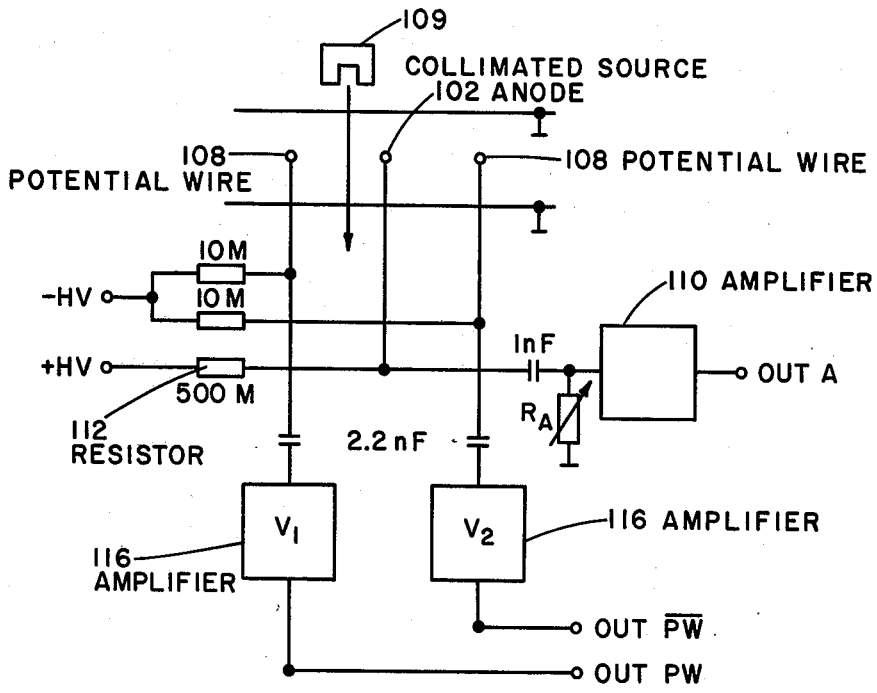
FIG. 9 is a schematic of the readout electronics used to test the subject invention.

A simple drift chamber cell was constructed (FIG. 8) containing one anode wire 102 between two cathode planes 106 and potential wires 108 limiting the drift space. FIG. 9 shows some details of the read-out. The anode was connected to the high voltage via a very large resistor 112 in order to measure the effect of a high input resistance of the amplifier 110 which could be varied over a wide range (25Ω . . . 100MΩ). The potential wires were read out by low noise charge sensitive amplifier 116. The signals on both potential wires as well as their difference were studied. The signal from the potential wire on the side of the primary ionization is designated here by Q(PW), the opposite side by $Q(\overline{PW})$. Unless otherwise indicated, the operating conditions of the chamber were as follows:

| | |
|---|---|
| counting gas | 0.9 Ar + 0.1 $CH_4$ |
| anode voltage | + 1.75 kV |
| dia | 30 μm |
| potential wire | − 0.20 kV |
| dia | 100 μm |
| avalanche size for minimum ionizing particles | $1.3 \times 10^7$ ion pairs |
| for 5.86 keV x-rays | $3.1 \times 10^7$ ion pairs |
| a | 20 mm |
| b | 10 mm |

Collimated source required was used to produce ionizing events of known distances from anode 102. The avalanche size was measured with resistor RA = 100MΩ, resulting in a time constant approx. 1.4 ms, long enough to determine the total number of ion pairs created by gas amplification.

Figure 10:
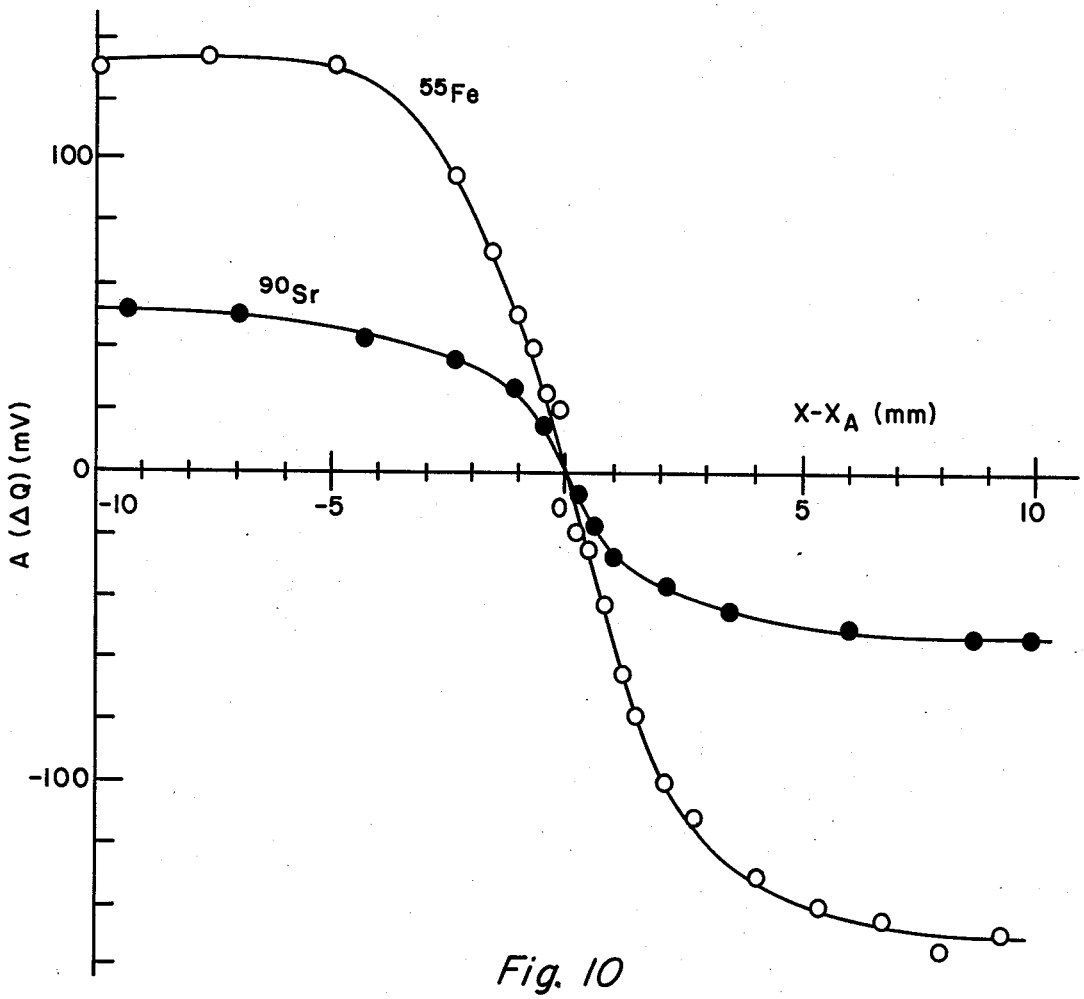
FIG. 10 is a graphic illustration of the left/right signal as a function of distance from that anode.

Typically $Q(\overline{PW})$ and $Q(\overline{PW})$ are almost equal during the period of fast rise (~100 ns). Then the signal of PW slowly continues to grow, while the signal on $\overline{PW}$ remains constant. Thus the difference $Q(\overline{PW})-Q(\overline{PW})$ is a slow rising signal. It contains the left-right information. Changing the side of the track changes the sign of this difference signal: $(PW-\overline{PW})\rightarrow(\overline{PW}-PW)$. FIG. 10 shows $\Delta Q=Q(PW)-Q(\overline{PW})$ as a function of the distance of the ionizing event from the anode for two radiation sources ($^{55}Fe$ and $^{90}Sr$).

What is claimed is:

1. An improved multiwire chamber for the detection and localization of ionizing radiation and having a plurality of anode wires wherein the improvement comprises:

(a) a pair of localizing wires spaced from substantially parallel to and coextensive with one of said anode wires, one wire of said pair being positioned on either side of said anode wire; and, (b) means for determining the difference in signal between the wires of said pair caused by an ionizing event, whereby the ambiguity as to whether said event occurred to the right or left of said anode wire may be resolved.

2. A multiwire chamber as described in claim 1 wherein said chamber is a drift chamber having field shaping electrodes and wherein a pair of said field shaping electrodes also function as said pair of localizing wires.

3. A multiwire chamber is described in claim 1 wherein a plurality of said localizing wires divides said chamber into a plurality of congruent cells, each centered on one of said anode wires.

4. A multiwire chamber as described in claim 3 wherein said chamber is a drift chamber having potential wires and wherein said potential wires also function as said localizing wires.

5. A multiwire chamber as described in claim 3 wherein said chamber is a multiwire proportional chamber having relatively closely spaced anode wires and wherein said anode wires function as said localizing wires.

6. A multiwire chamber as described in claim 3 wherein said chamber is a drift chamber having only anode wires and wherein said anode wires function as said localizing wires.

* * * * *